US011296445B2

(12) United States Patent
Shen et al.

(10) Patent No.: US 11,296,445 B2
(45) Date of Patent: Apr. 5, 2022

(54) TERMINAL ASSEMBLY AND BOARD END CONNECTOR

(71) Applicant: Dongguan Luxshare Technologies Co., Ltd, Dongguan (CN)

(72) Inventors: XueHai Shen, Dongguan (CN); RongZhe Guo, Dongguan (CN); HongJi Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/026,980

(22) Filed: Sep. 21, 2020

(65) Prior Publication Data

US 2021/0336361 A1 Oct. 28, 2021

(30) Foreign Application Priority Data

Apr. 24, 2020 (CN) ..... 202010335250.6

(51) Int. Cl.
*H01R 12/73* (2011.01)
*H01R 12/70* (2011.01)
(Continued)

(52) U.S. Cl.
CPC ..... *H01R 12/737* (2013.01); *H01R 12/7005* (2013.01); *H01R 13/115* (2013.01);
(Continued)

(58) Field of Classification Search
CPC .. H01R 12/737; H01R 13/50; H01R 12/7005; H01R 13/115; H01R 13/6581;
(Continued)

(56) References Cited

U.S. PATENT DOCUMENTS 7,232,344 B1 * 6/2007 Gillespie ..... H01R 13/26 439/634
7,753,731 B2 * 7/2010 Cohen ..... H01R 13/6587 439/607.09
(Continued)

FOREIGN PATENT DOCUMENTS

CN 210350162 U 4/2020
TW M599485 U 8/2020

*Primary Examiner* — Travis S Chambers
(74) *Attorney, Agent, or Firm* — Birch, Stewart, Kolasch & Birch, LLP

(57) ABSTRACT

The present disclosure provides a terminal assembly and board end connector. The terminal assembly comprises a plurality of terminals, a terminal insulation body and a conductive plastic. Each of the terminals comprises a terminal body, a plugging end part and a connecting end part. The plugging end part and the connecting end part are provided at two ends of the terminal body. The terminal insulation body covers the plurality of the terminal bodies of the plurality of terminals. The conductive plastic is disposed on one side of the terminal insulation body. A surface of the conductive plastic close to the terminal body is parallel to the terminal body. The SI performance of the board end connector equipped with the terminal assembly of the present disclosure can be improved by paralleling a surface of the conductive plastic close to the terminal body to the terminal body.

14 Claims, 10 Drawing Sheets

(51) Int. Cl.

| | |
|---|---|
| ***H01R 13/115*** | (2006.01) |
| ***H01R 13/50*** | (2006.01) |
| ***H01R 13/6585*** | (2011.01) |
| ***H01R 13/405*** | (2006.01) |
| ***H01R 13/502*** | (2006.01) |
| ***H01R 13/516*** | (2006.01) |
| ***H01R 13/40*** | (2006.01) |
| *H01R 13/6581* | (2011.01) |

(52) U.S. Cl.
CPC ..... *H01R 13/40* (2013.01); *H01R 13/405* (2013.01); *H01R 13/50* (2013.01); *H01R 13/502* (2013.01); *H01R 13/516* (2013.01); *H01R 13/6585* (2013.01); *H01R 13/6581* (2013.01)

(58) Field of Classification Search
CPC .... H01R 12/716; H01R 12/721; H01R 12/73; H01R 13/6599; H01R 13/6594; H01R 13/405; H01R 13/508; H01R 24/60; H01R 13/6585; H01R 12/714; H01R 13/40; H01R 13/502; H01R 13/516
USPC ..... 439/636, 637
See application file for complete search history.

(56) References Cited

U.S. PATENT DOCUMENTS

| | | | | |
|---|---|---|---|---|
| 8,083,553 | B2 * | 12/2011 | Manter | H01R 13/518 439/701 |
| 8,182,289 | B2 * | 5/2012 | Stokoe | H01R 12/721 439/607.11 |
| 8,371,875 | B2 * | 2/2013 | Gailus | H01R 13/6476 439/607.02 |
| 10,541,482 | B2 * | 1/2020 | Sasame | H01R 13/514 |
| 10,777,921 | B2 * | 9/2020 | Lu | H01R 12/82 |
| 10,840,622 | B2 * | 11/2020 | Sasame | H01R 13/6585 |
| 2012/0202386 | A1 * | 8/2012 | McNamara | H01R 13/6461 439/629 |
| 2019/0173232 | A1 * | 6/2019 | Lu | H01R 13/6272 |
| 2020/0266584 | A1 * | 8/2020 | Lu | H01R 12/79 |
| 2021/0135389 | A1 * | 5/2021 | Jiang | H01R 13/405 |

* cited by examiner

TERMINAL ASSEMBLY AND BOARD END CONNECTOR

CROSS REFERENCE TO RELATED APPLICATION

This application claims the priority benefit of Chinese Patent Application Serial Number CN202010335250.6, filed on Apr. 24, 2020, the full disclosure of which is incorporated herein by reference.

BACKGROUND

Technical Field

The present disclosure relates to the technical field of connector, particularly to a terminal assembly and board end connector.

Related Art

The SI performance is crucial for conventional designing for connector. Test data of the SI performance of a connector includes characteristic impedance, insertion loss and return loss, near-end crosstalk and far-end crosstalk. The terminal assembly of conventional connector comprises a plurality of terminals and conductive plastic realizing the functions of electromagnetic shielding and conduction. The structural shape of the conductive plastic corresponding to the terminal affects the SI performance of the connector.

SUMMARY

The embodiments of the present disclosure provide a terminal assembly and board end connector to solve the problem that the SI performance of the connector could be affected by the conductive plastic of conventional terminal assembly of the connector.

On the first aspect, the embodiments of the present disclosure provide a terminal assembly, comprising a plurality of terminals, a terminal insulation body and a conductive plastic. Each of the terminals comprises a terminal body, a plugging end part and a connecting end part. The plugging end part and the connecting end part are provided at two ends of the terminal body. The terminal insulation body covers the plurality of the terminal bodies of the plurality of terminals. The conductive plastic is disposed on one side of the terminal insulation body. A surface of the conductive plastic close to the terminal body is parallel to the terminal body.

On the second aspect, the embodiments of the present disclosure provide a board end connector, comprising a connector body and two terminal assemblies in the first aspect. The connector body comprises a terminal accommodating groove, a plugging slot and a positioning member. The plugging slot is communicated with the terminal accommodating groove. The terminal accommodating groove comprises an accommodating opening. The plugging slot comprises a plugging opening. The positioning member is disposed in the terminal accommodating groove. Two ends of the positioning member are respectively connected to two opposite sidewalls in the terminal accommodating groove. The two terminal assemblies are disposed in the connector body. The terminal insulation body and the conductive plastic of each of the terminal assemblies are disposed in the terminal accommodating groove. The conductive plastic is adjacent to the positioning member. The plurality of the plugging end parts of the plurality of terminals of each of the terminal assemblies are disposed in the plugging slot.

The embodiments of the present disclosure could improve the SI performance of the board end connector equipped with the terminal assembly of the present disclosure by paralleling a surface of the conductive plastic close to the terminal body to the terminal body.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
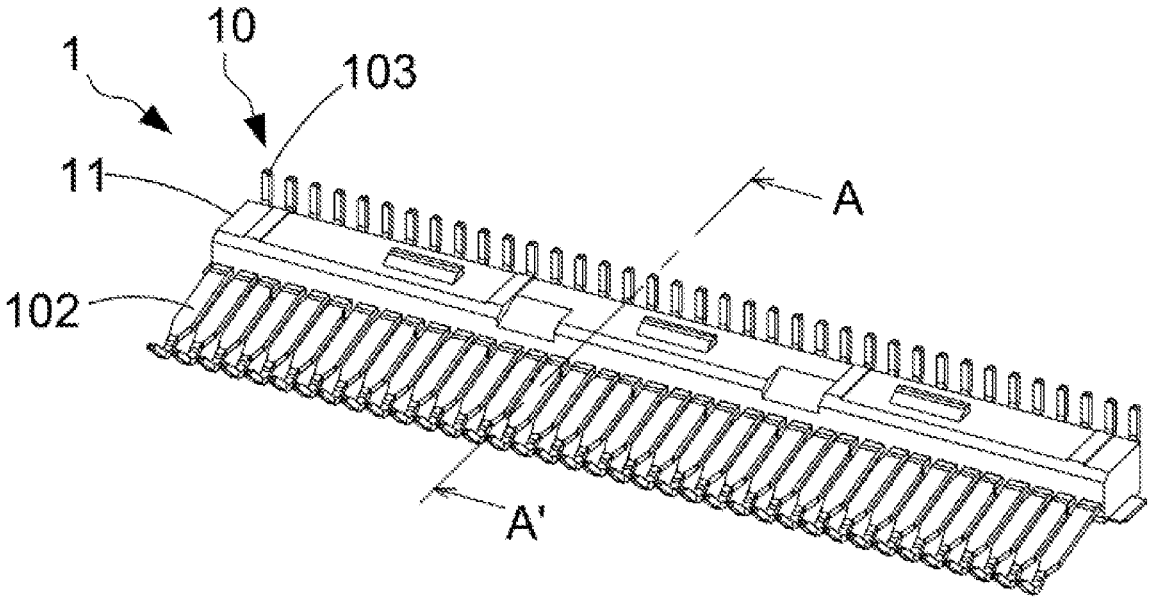
FIG. 1 is a perspective view of a connector assembly of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an" does not exclude other same elements existing in the process, the method, the article, or the device which includes the element.

In the following embodiment, the same reference numerals are used to refer to the same or similar elements throughout the disclosure.

Figure 2:
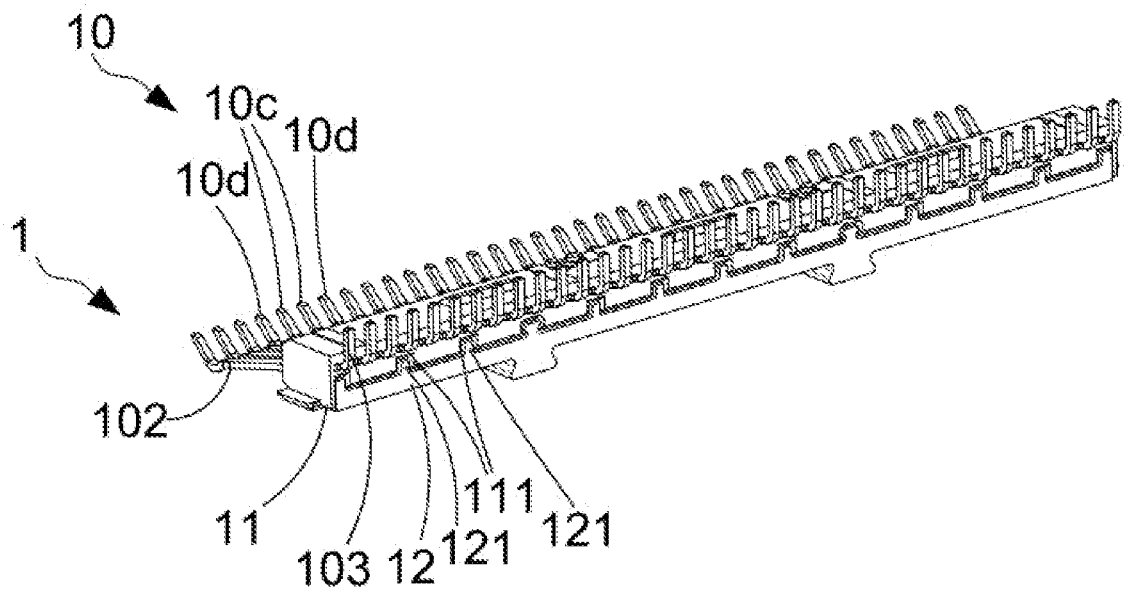
FIG. 2 is another perspective view of the connector assembly of the first embodiment of the present disclosure.
Figure 3:
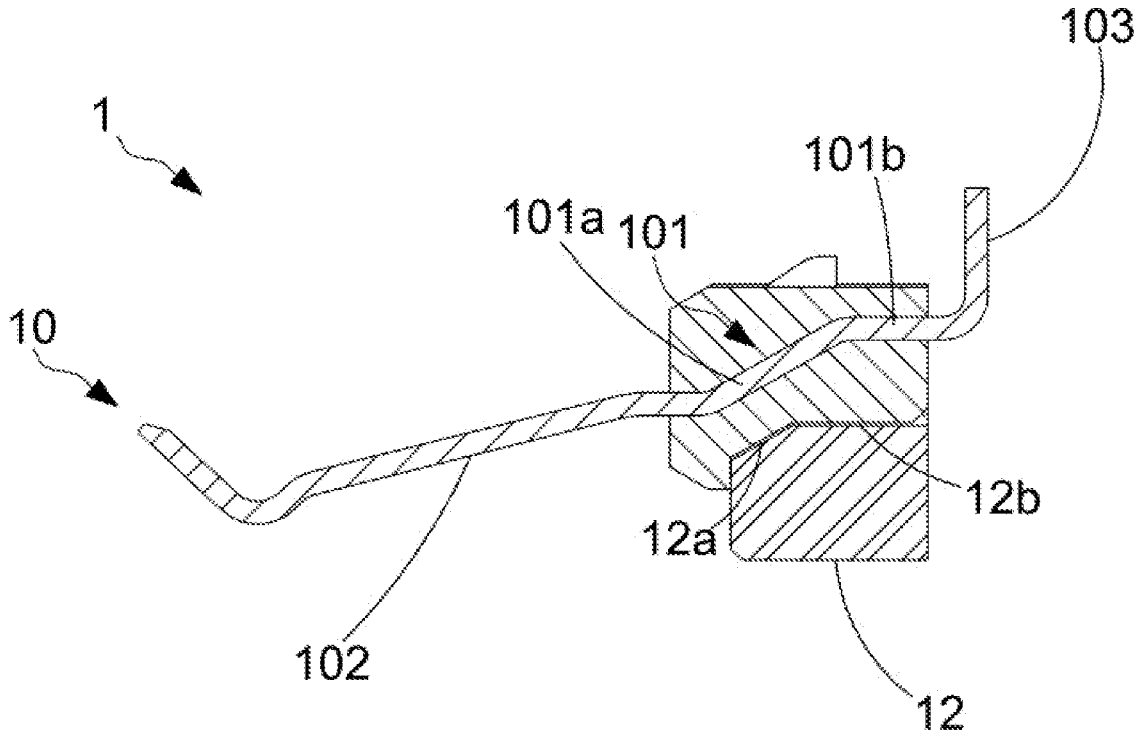
FIG. 3 is a cross-sectional view along line A-A' in FIG. 1.

FIG. 1 and FIG. 2 are perspective views of a connector assembly of the first embodiment of the present disclosure. FIG. 3 is a cross-sectional view along line A-A' in FIG. 1. As shown in the figure, the terminal assembly 1 of this embodiment comprises a plurality of terminals 10, a terminal insulation body 11 and a conductive plastic 12. A plurality of terminals 10 are disposed at intervals. Each of the terminals 10 comprises a terminal body 101, a plugging end part 102 and a connecting end part 103. The plugging end part 102 and the connecting end part 103 are provided at two ends of the terminal body 101. The terminal insulation body 11 covers the plurality of the terminal bodies 101 of the plurality of terminals 10. The plugging end part 102 and the connecting end part 103 are exposed from the terminal insulation body 11. The conductive plastic 12 is disposed on one side of the terminal insulation body 11. A surface of the conductive plastic 12 close to the terminal body 101 of each of the terminals 10 is parallel to the terminal body 101. In this way, the SI performance of the board end connector equipped with the terminal assembly 1 can be improved.

In this embodiment, the terminal body 101 comprises a first body part 101*a* and a second body part 101*b* connected to the first body part 101*a*. The plugging end part 102 is connected to the first body part 101*a*. The connecting end part 103 is connected to the second body part 101*b*. An angle is formed between the extending direction of the first body part 101*a* and the extending direction of the second body part 101*b*. The first body part 101*a* is bent and inclined relative to the second body part 101*b*. A surface of the conductive body 12 close to the terminal body 101 of each terminal 10 is parallel to the terminal body 101. The surface of the conductive body 12 close to the terminal body 101 of each terminal 10 comprises a first surface 12*a* and a second surface 12*b*. The first surface 12*a* corresponds to and is parallel to the first body part 101*a*. The second surface 12*b* corresponds to and is parallel to the second body part 101*b*. The appearance of the above terminal body 101 is only an embodiment of the present disclosure, which should not be limited thereto.

In one embodiment, the terminal insulation body 11 comprises a plurality of recesses 111 disposed at intervals. The plurality of recesses 111 are disposed on a surface of the terminal insulation body 11 adjacent to the conductive plastic 12. The plurality of recesses 111 respectively correspond to a part of the plurality of terminals 10. The conductive plastic 12 comprises a plurality of bumps 121 disposed at intervals. The plurality of bumps 121 are disposed on a surface of the conductive plastic 12 adjacent to the terminal insulation body 11. The plurality of bumps 121 are respectively disposed in the corresponding recesses 111, so the plurality of bumps 121 could correspond to a part of the plurality of terminals 10. The terminal 10 comprises a plurality of signal terminals 10*c* and a plurality of ground terminals 10*d*. At least one signal terminal 10*c* is disposed between two adjacent ground terminals 10*d*. The plurality of recesses 111 of the terminal insulation body 11 respectively correspond to the plurality of ground terminals 10*d*. Thus, the plurality of bumps 121 of the conductive plastic 12 respectively correspond to the plurality of ground terminals 10*d*. The distance between an end surface of each bump 121 away from the conductive plastic 12 and the corresponding ground terminal 10*d* is shorter than the distance between a surface of the conductive plastic 12 adjacent to the terminal insulation body 11 and the signal terminal 10*c*. In other words, through the bump 121 extendingly disposed on the conductive plastic 12, the distance between the conductive plastic 12 and the ground terminal 10*d* would be shorter than the distance between the conductive plastic 12 and the signal terminal 10*c* to perform the electromagnetic shielding and electrical conduction.

Figure 4:
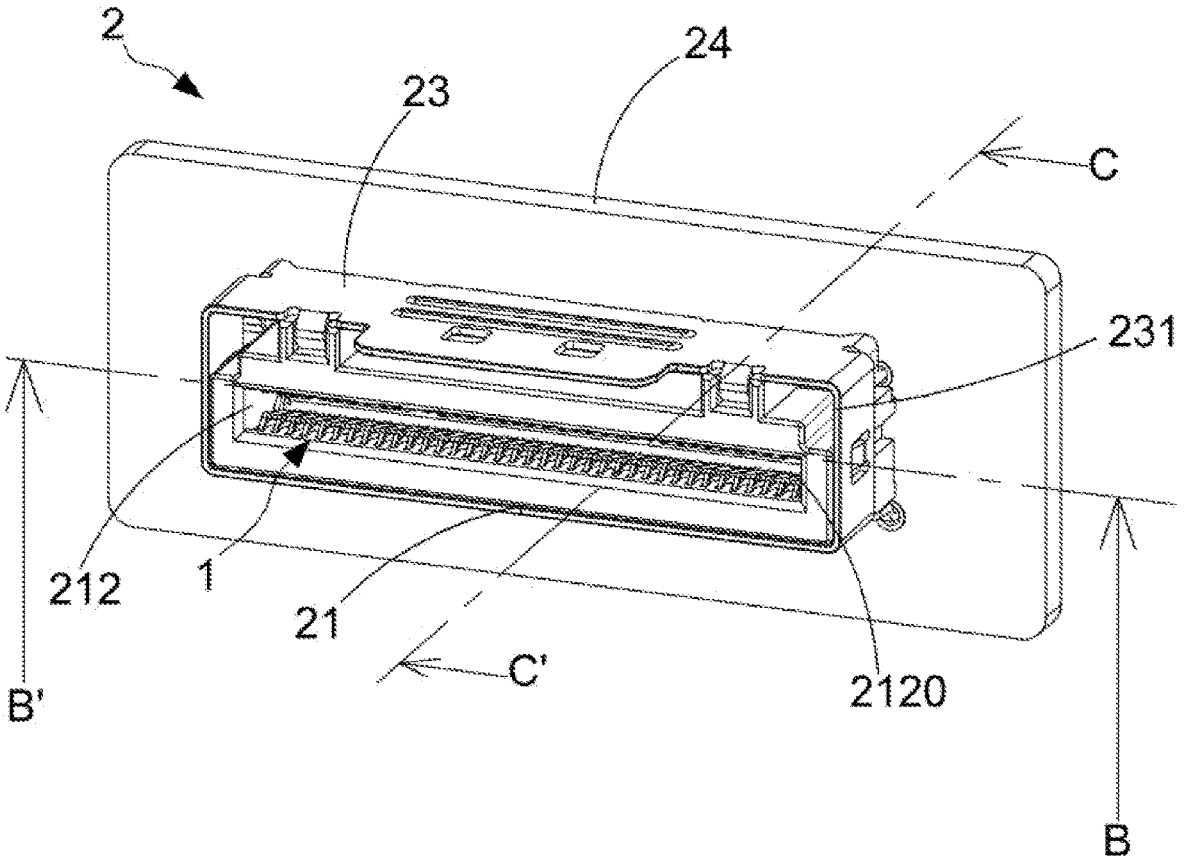
FIG. 4 is a perspective view of a board end connector of the second embodiment of the present disclosure.
Figure 5:
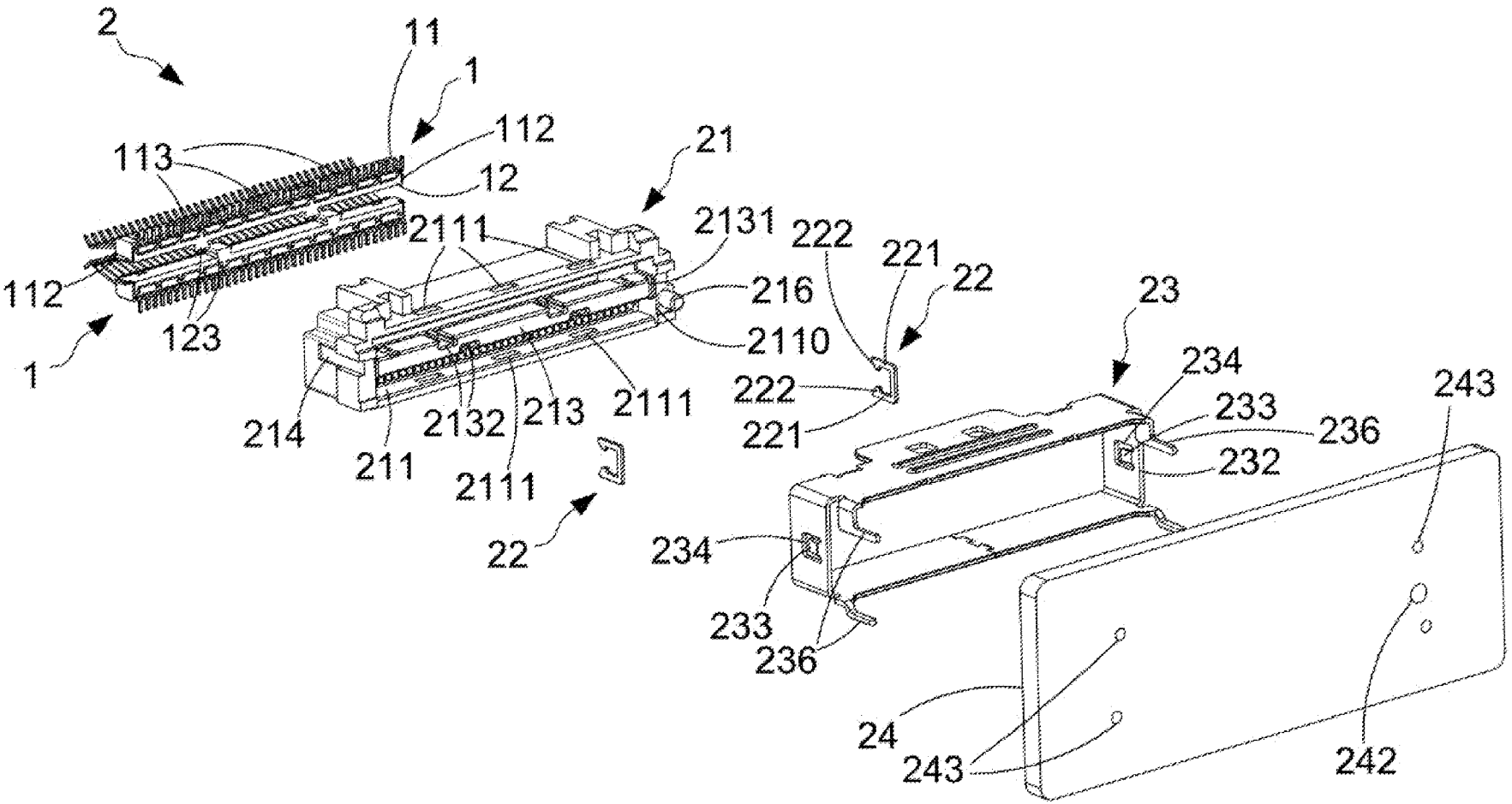
FIG. 5 is an exploded view of the board end connector of the second embodiment of the present disclosure.
Figure 6:
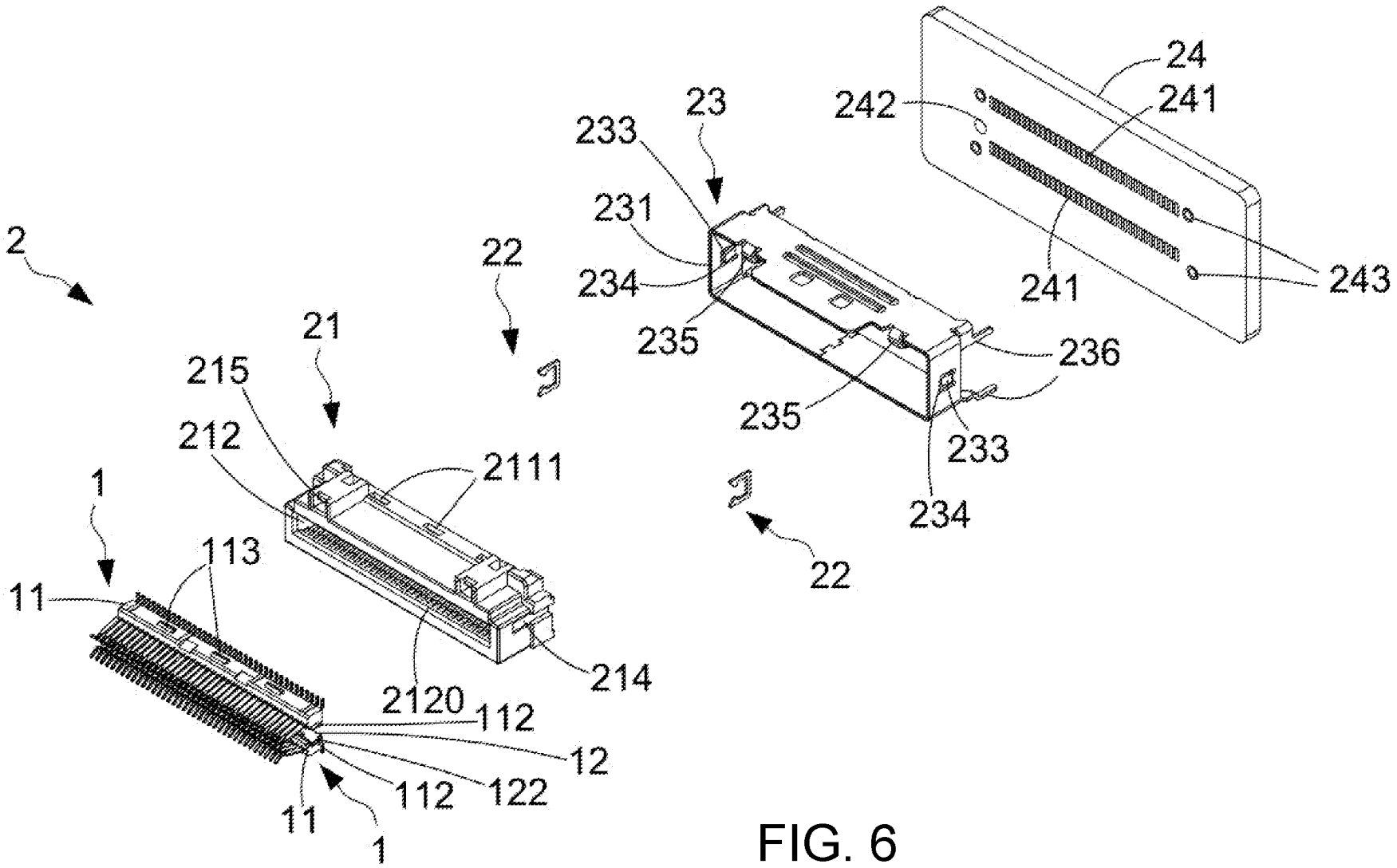
FIG. 6 is another exploded view of the board end connector of the second embodiment of the present disclosure.

FIG. 4 to FIG. 6 are perspective view and exploded views of a board end connector of the second embodiment of the present disclosure. As shown in the figure, the board end connector 2 of this embodiment comprises a connector body 21 and two terminal assemblies 1. The connector body 21 comprises a terminal accommodating groove 211, a plugging slot 212 and a positioning member 213. The plugging slot 212 is communicated with the terminal accommodating groove 211. The terminal accommodating groove 211 comprises an accommodating opening 2110. The plugging slot 212 comprises a plugging opening 2120. The plugging opening 2120 is opposite to the accommodating opening 2110. The accommodating opening 2110 and the plugging opening 2120 are disposed on two opposite end surfaces of the connector body 21. The positioning member 213 is disposed in the terminal accommodating groove 211. Two ends of the positioning member 213 are respectively connected to two opposite sidewalls in the terminal accommodating groove 211. Each of the terminal assemblies 1 is a terminal assembly of the first embodiment. The two terminal assemblies 1 are disposed in the connector body 21. Each of the terminal assemblies 1 is inserted into the terminal accommodating groove 211 and the plugging slot 212 through the accommodating opening 2110. The terminal insulation body 11 and the conductive plastic 12 of each of the terminal assemblies 1 are disposed in the terminal accommodating groove 211. The conductive plastic 12 is adjacent to the positioning member 213. The plurality of the plugging end parts 102 of the plurality of terminals 10 of each of the terminal assemblies 1 are disposed in the plugging slot 212.

Figure 7:
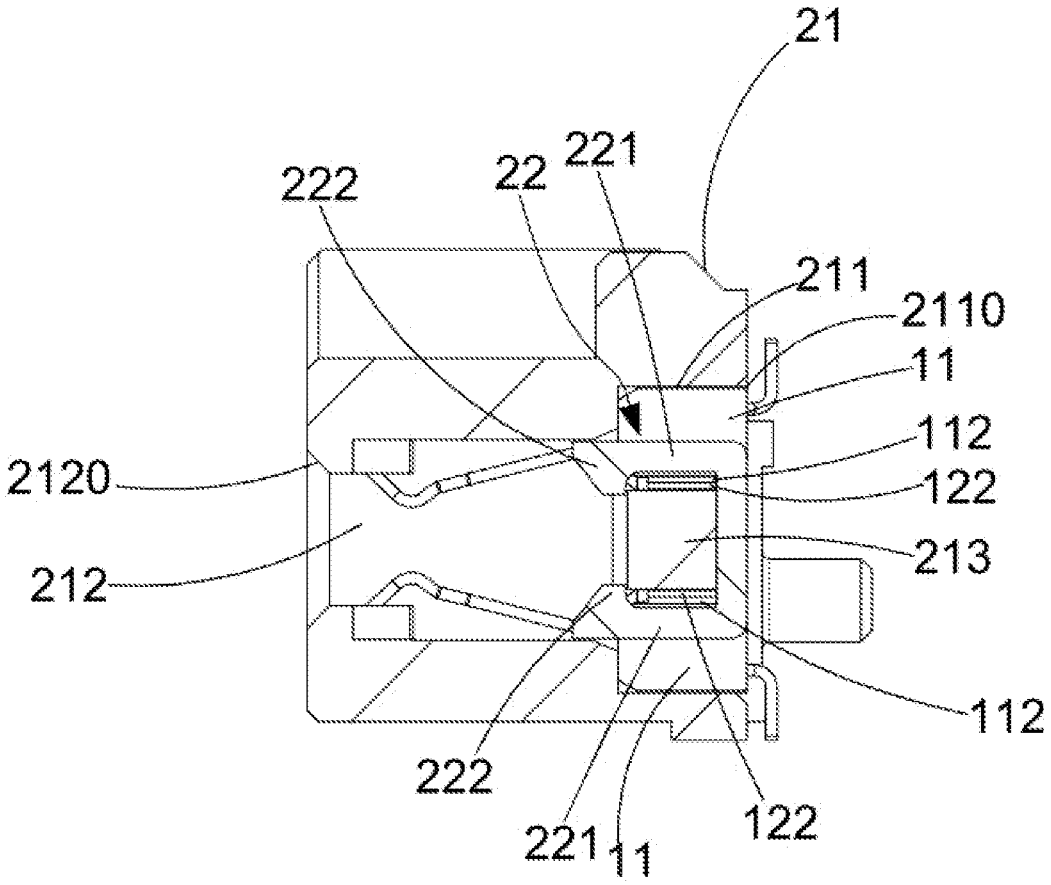
FIG. 7 is a cross-sectional view of the combination of a terminal assembly, a connector body and an elastic buckling member of the second embodiment of the present disclosure.

In one embodiment, two ends of the terminal insulation body 11 of each of the terminal assemblies 1 comprise a first securing bump 112, respectively. The two first securing bumps 112 are disposed on a surface of the positioning member 213 adjacent to the conductive plastic 12. FIG. 7 is a cross-sectional view of the combination of a terminal assembly, a connector body and an elastic buckling member of the second embodiment of the present disclosure. As shown in the figure, the board end connector 2 further comprises two elastic buckling members 22 buckled at two ends of the positioning member 213. The two first securing bumps 112 on the same end are secured to the positioning member 213 by the elastic buckling member 22. Each of the conductive plastics 12 is secured onto the positioning member 213 through the terminal body 101 to secure the two terminal assemblies 1 onto the connector body 21.

Each of the elastic buckling members 22 comprises two securing elastic arms 221 and two buckles 222. One securing elastic arm 221 is opposite to the other securing elastic arm 221. One end of one securing elastic arm 221 is connected to one end of the other securing elastic arm 221. The two buckles 222 are respectively disposed on the other ends of the two securing elastic arms 221. When the elastic buckling member 22 is disposed on the positioning member 213 through the accommodating opening 2110 of the terminal accommodating groove 211, the two securing elastic arms 221 respectively press against the first securing bumps 112 on two opposite surfaces of the positioning member 213, and the two buckles 222 respectively abut against a surface of the positioning member 213 close to the plugging slot 212. In this way, the two securing elastic arms 221 of the elastic buckling member 22 would clamp the two first securing bumps 112 stably onto the positioning member 213. The conductive plastic 12 is secured onto the positioning member 213 by the terminal body 101 of each of the terminal assemblies 1. So, the two terminal assemblies 1 can be secured in the connector body 21. In one embodiment, two ends of the positioning member 213 are respectively provided with buckling recesses 2131. Each of the elastic buckling members 22 can be buckled into the buckling recess 2131, preventing the buckling member 22 from sliding on the positioning member 213, also aligning a surface of each of the elastic buckling members 22 close to the accommodating opening 2110 with a surface of the positioning member 213 close to the accommodating opening 2110. The elastic buckling member 22 of this embodiment is made of metal or plastic.

In one embodiment, the two ends of the conductive plastic 12 of each of the terminal assemblies 1 respectively comprise a second securing bumps 122. Each of the second securing bumps 122 is disposed between the corresponding first securing bump 112 and the positioning member 213. In this way, there would be no gap between the first securing bump 112 and the positioning member 213, so that the conductive plastic 12 can be secured on the positioning member 213.

Figure 8:
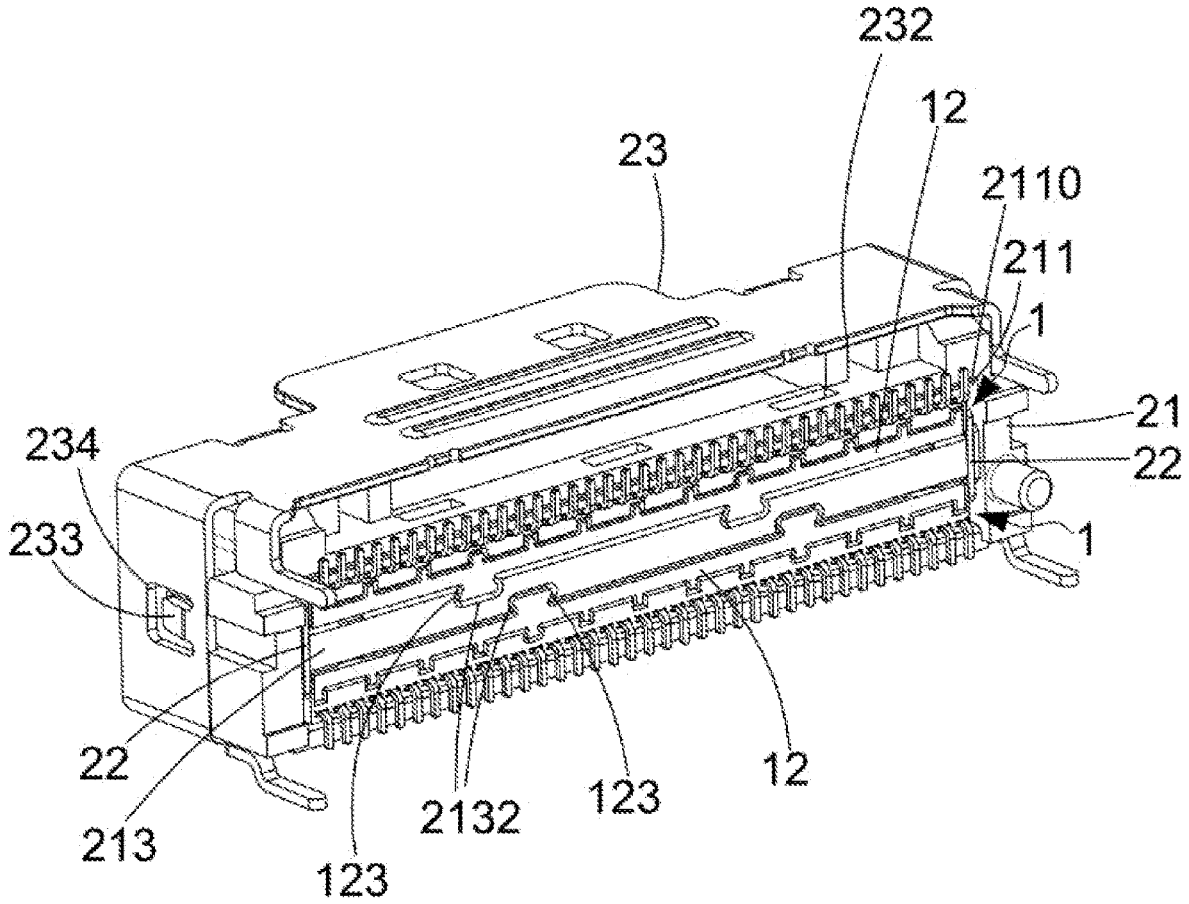
FIG. 8 is a partial perspective view of the board end connector of the second embodiment of the present disclosure.

In one embodiment, the positioning member 213 comprises a plurality of first positioning parts 2132 disposed on a surface of the positioning member 213 adjacent to the conductive plastic 12, respectively. The conductive plastic 12 of each of the terminal assemblies 1 comprises a plurality of second positioning parts 123 disposed on a surface of the conductive plastic 12 away from the terminal insulation body 11. FIG. 8 is a partial perspective view of the board end connector of the second embodiment of the present disclosure. As shown in the figure, when the terminal assembly 1 is disposed in the terminal accommodating groove 211, a plurality of second positioning parts 123 are respectively disposed on the corresponding first positioning parts 2132. The shape of a cross sectional area of the first positioning part 2132 matches the shape of a cross sectional area of the second positioning part 123. The cross sectional surface of the first positioning part 2132 and the cross sectional surface of the second positioning part 123 are parallel to a surface of the connector body 21 having an accommodating opening 2110. In this embodiment, the first positioning part 2132 is a recess. The second positioning part 123 is a bump. The width of one end of the second positioning part 123 close to the conductive plastic 12 is narrower than the width of one end of the second positioning part 123 away from the conductive plastic 12, that is, the opening width of the first positioning part 2132 close to the conductive plastic 12 is narrower than the opening width of the first positioning part 2132 away from the conductive plastic 12. The second positioning part 123 is slidably connected to the first positioning part 2132. The second positioning part 123 cannot be detached from the first positioning part 2132 in a direction perpendicular to a surface of the positioning member 213 adjacent to the conductive plastic 12. The first positioning part 2132 can also be a bump, and the second positioning part 123 can also be a recess.

In one embodiment, the terminal accommodating groove 211 comprises a plurality of first buckling parts 2111 disposed on two sidewalls in the terminal accommodating groove 211 relative to the positioning member 213. The terminal insulation body 11 of each of the terminal assemblies 1 comprises a plurality of second buckling parts 113 disposed on a surface of the terminal insulation body 11 away from the conductive plastic 12. When each of the terminal assemblies 1 is disposed in the terminal accommodating groove 211, the plurality of second buckling parts 113 of the terminal insulation body 11 of each of the terminal assemblies 1 are respectively buckled with the corresponding first buckling parts 2111. So, the each of the terminal assemblies 1 can be secured in the terminal accommodating groove 211. In this embodiment, the first buckling part 2111 is a hole, and the second buckling part 113 is a bump.

Figure 9:
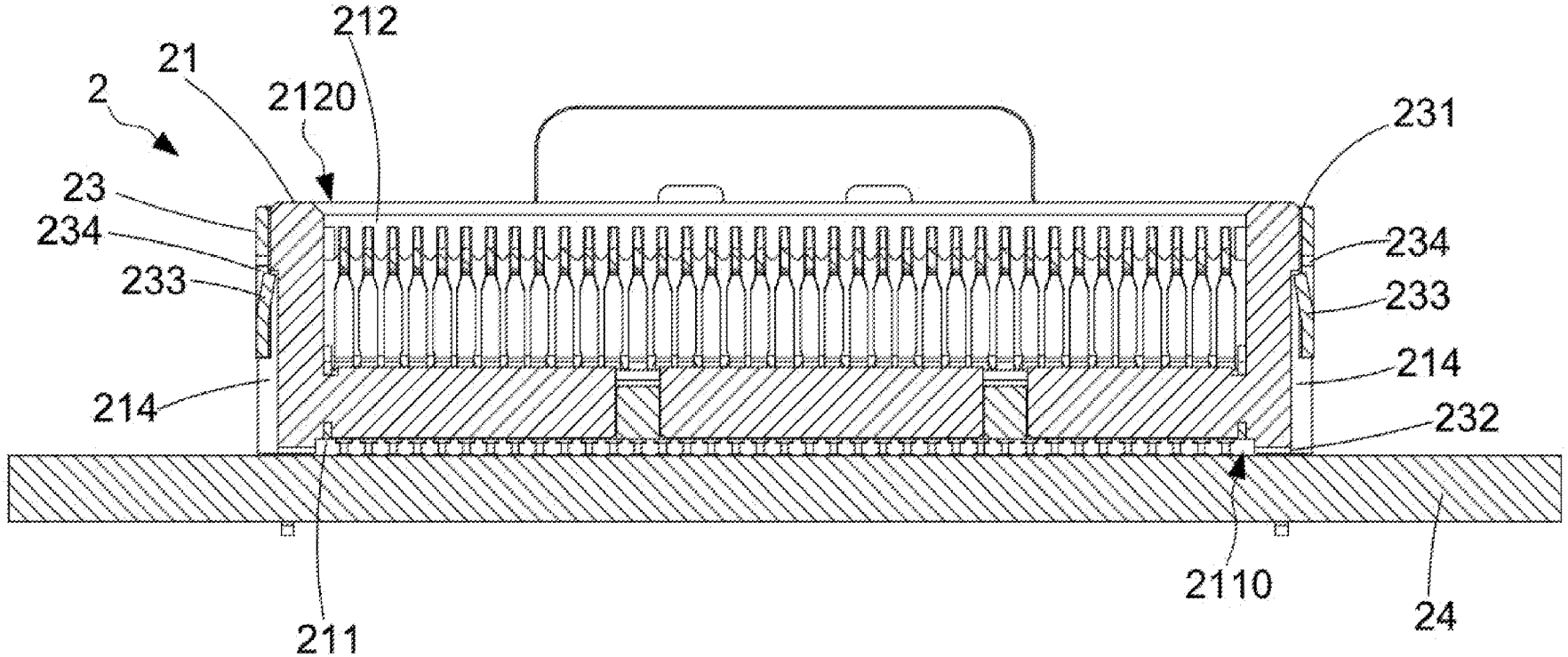
FIG. 9 is a cross-sectional view along line B-B' in FIG. 4.

FIG. 9 is a cross-sectional view along line B-B' in FIG. 4. In one embodiment, as shown in the figure, the board end connector 2 further comprises a housing 23 disposed on the connector body 21. The housing 23 comprises a first opening 231 and a second opening 232. The first opening 231 corresponds to the plugging opening 2120 of the plugging slot 212. The second opening 232 corresponds to the accommodating opening 2110 of the terminal accommodating groove 211. The housing 23 comprises two buckling elastic plates 233. Each of the buckling elastic plates 233 protrudes from an inner surface of the housing 23, and extends toward the first opening 231. The connector body 21 comprises two first buckling grooves 214. When the connector body 21 is disposed on the housing 23, each of the buckling elastic plates 233 would be disposed in the corresponding first buckling groove 214. One end of the buckling elastic plate 233 close to the first opening 231 abuts against a sidewall of the first buckling groove 214 close to the first opening 231, preventing the connector body 21 from detaching from the second opening 232 of the housing 23. In an embodiment, the housing 23 also comprises two retaining openings 234. One end of each of the buckling elastic plates 233 and the corresponding retaining opening 234 are away from a side of the first opening 231. Each of the buckling elastic plates 233 is disposed in the corresponding retaining opening 234. When the connector body 21 is installed on the housing 23, each of the buckling elastic plates 233 is pressed by the connector body 21 and moves into the corresponding retaining opening 234. In other words, the retaining opening 234 provides a space for moving for the buckling elastic plate 233, preventing the installation of the connector body 21 from being affected by the buckling elastic plate 233.

Figure 10:
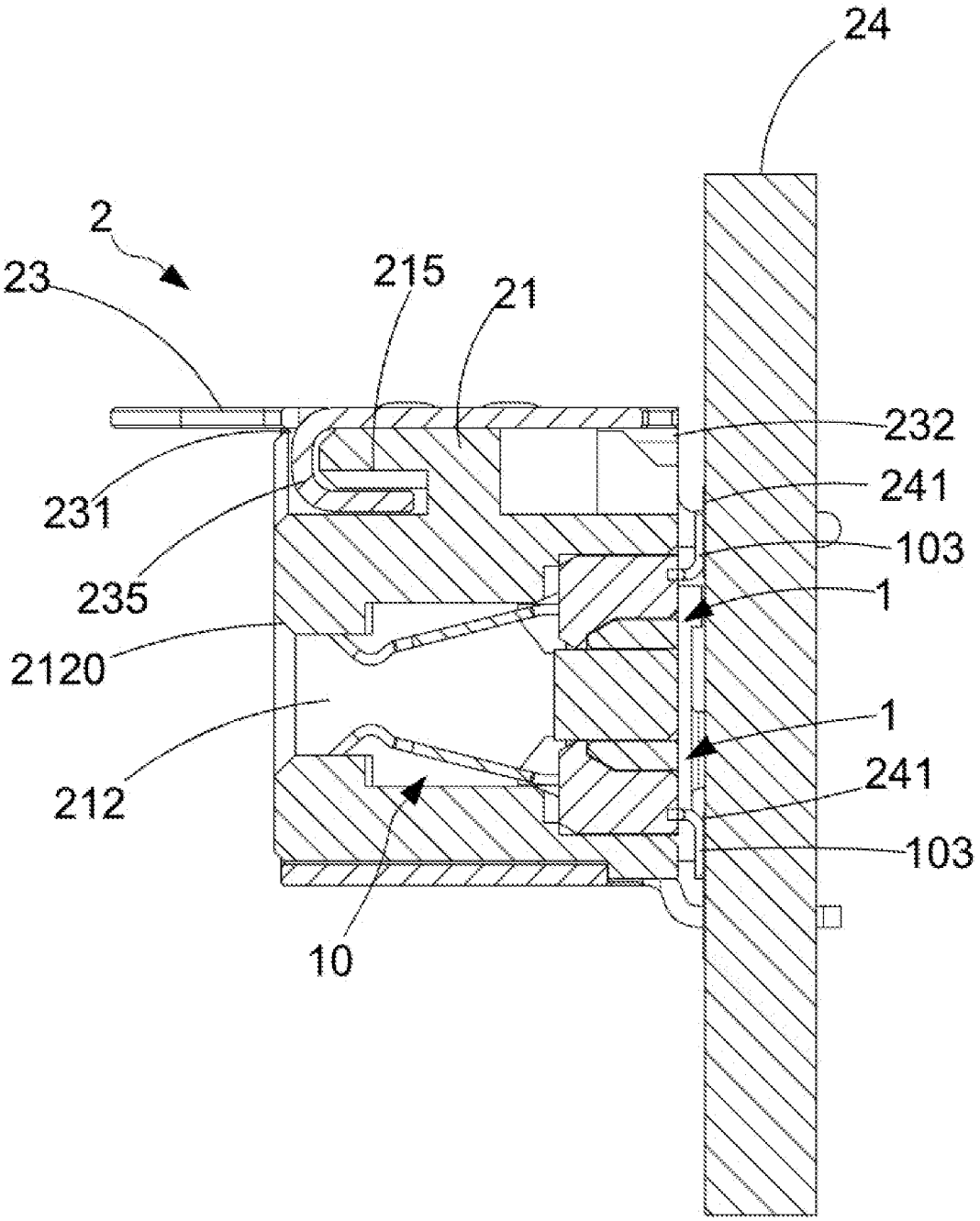
FIG. 10 is a cross-sectional view along line C-C' in FIG. 4.

FIG. 10 is a cross-sectional view along line C-C' in FIG. 4. As shown in the figure, the housing 23 comprises a buckling member 235 disposed on a side of the first opening 231. The buckling member 235 extends toward the second opening 232. The connector body 21 comprises a second buckling groove 215 disposed on a side of the plugging opening 2120 of the plugging slot 212. When the connector body 21 is disposed on the housing 23, the buckling member 235 is disposed in the second buckling groove 215 and abuts against a sidewall of the second buckling groove 215 away from the first opening 231, preventing the connector body 21 from detaching from the first opening 231.

In one embodiment, the board end connector 2 further comprises a circuit board 24 disposed on the housing 23. The circuit board 24 is disposed on one side of a surface of the connector body 21 having the accommodating opening 2110. The circuit board 24 comprises a plurality of contacting pads 241 disposed at intervals. The plurality of connecting end part 103 of the plurality of terminals 10 of each of the terminal assemblies 1 are electrically connected to the plurality of contacting pads 241. The connector body 21 comprises a positioning cylinder 216 disposed on a surface of the connector body 21 having the accommodating opening 2110. The circuit board 24 comprises a positioning hole 242. When the circuit board 24 is disposed on the housing 23, the positioning cylinder 216 is disposed in the positioning hole 242, allowing the plurality of connecting end parts 103 to be electrically connected to the plurality of contacting pads 241 accurately. The housing 23 further comprises a plurality of plugging members 236 disposed on the periphery of the second opening 232. The circuit board 24 comprises a plurality of jacks 243. The plurality of plugging members 236 are respectively inserted into the corresponding jacks 243, securing the housing 23 onto the circuit board 24.

In summary, the present disclosure provides a terminal assembly and board end connector, improving the SI performance of the board end connector equipped with the terminal assembly of the present disclosure by paralleling a surface of the conductive plastic close to the terminal body to the terminal body.

It is to be understood that the term "comprises", "comprising", or any other variants thereof, is intended to encompass anon-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A terminal assembly, comprising:

a plurality of terminals, each of the terminals comprising a terminal body, a plugging end part and a connecting end part, the plugging end part and the connecting end part being provided at two ends of the terminal body;

a terminal insulation body covering the plurality of the terminal bodies of the plurality of terminals;

a conductive plastic disposed on one side of the terminal insulation body, a surface of the conductive plastic close to the terminal body being parallel to the terminal body;

wherein a portion of the terminal insulation body is disposed between the terminal body and the conductive plastic, the terminal body comprises a first body part and a second body part connected to the first body part; the plugging end part is connected to the first body part; the connecting end part is connected to the second body part; the first body part is inclined relative to the second body part; the surface of the conductive plastic close to the terminal body comprises a first surface and a second surface; the first surface corresponds to the first body part; the first surface is parallel to the first body part; the second surface corresponds to the second body part; and the second surface is parallel to the second body part.

2. The terminal assembly according to claim 1, wherein the terminal insulation body comprises a plurality of recesses disposed at intervals; the plurality of recesses are disposed on a surface of the terminal insulation body adjacent to the conductive plastic; the plurality of recesses correspond to a part of the plurality of terminals; the conductive plastic comprises a plurality of bumps disposed at intervals; the plurality of bumps are disposed on a surface of the conductive plastic adjacent to the terminal insulation body; the plurality of bumps are respectively disposed in the corresponding recesses.

3. The terminal assembly according to claim 2, wherein the plurality of terminals comprise a plurality of signal terminals and a plurality of ground terminals; the plurality of recesses correspond to the plurality of ground terminals; the distance between an end surface of each of the bumps away from the conductive plastic and the corresponding ground terminal is smaller than the distance between a surface of the conductive plastic adjacent to the terminal body and the signal terminal.

4. A board end connector, comprising:

a connector body comprising a terminal accommodating groove, a plugging slot and a positioning member, the plugging slot being communicated with the terminal accommodating groove, the terminal accommodating groove comprising an accommodating opening, the plugging slot comprising a plugging opening, the positioning member being disposed in the terminal accommodating groove, two ends of the positioning member being respectively connected to two opposite sidewalls in the terminal accommodating groove;

two terminal assemblies according to claim 1, the terminal assemblies being disposed in the connector body, the terminal insulation body and the conductive plastic of each of the terminal assemblies being disposed in the terminal accommodating groove, the conductive plastic being adjacent to the positioning member, the plurality of the plugging end parts of the plurality of terminals of each of the terminal assemblies being disposed in the plugging slot.

5. The board end connector according to claim 4, wherein the terminal accommodating groove comprises a plurality of first buckling parts disposed on two sidewalls in the terminal accommodating groove relative to the positioning member; the terminal insulation body of each of the terminal assemblies comprises a plurality of second buckling parts disposed on a surface of the terminal insulation body away from the conductive plastic; the plurality of second buckling parts are respectively buckled with the corresponding first buckling parts.

6. The board end connector according to claim 4, wherein the positioning member comprises a plurality of first positioning parts respectively disposed on a surface of the positioning member adjacent to the conductive plastic; the conductive plastic of each of the terminal assemblies further comprises a plurality of second positioning parts is disposed on a surface of the conductive plastic away from the terminal insulation body; the plurality of the second positioning parts are respectively disposed on the corresponding first positioning parts.

7. The board end connector according to claim 6, wherein a shape of a cross sectional area of the first positioning part matches a shape of a cross sectional area of the second positioning part; a cross sectional surface of the first positioning part and a cross sectional surface of the second positioning part are parallel to a surface of the connector body having the accommodating opening.

8. The board end connector according to claim 7, wherein the first positioning part is a recess; the opening width of the first positioning part close to the conductive plastic is narrower than the opening width of the first positioning part away from the conductive plastic; the second positioning part is a bump; the width of one end of the second positioning part close to the conductive plastic is narrower than the width of one end of the second positioning part away from the conductive plastic.

9. The board end connector according to claim 4 further comprises a housing disposed on the connector body; the housing comprises a first opening and a second opening; the first opening corresponds to the plugging opening; the second opening corresponds to the accommodating opening.

10. The board end connector according to claim 9, wherein the housing comprises two buckling elastic plates; each of the buckling elastic plates protrudes from an inner surface of the housing, extending toward the first opening; the connector body comprises two first buckling grooves; each of the buckling elastic plates is disposed in the corresponding first buckling groove; one end of the buckling elastic plate close to the first opening abuts against a sidewall of the first buckling groove close to the first opening.

11. The board end connector according to claim 10, wherein the housing comprises a buckling member disposed on a side of the first opening; the buckling member extends toward the second opening; the connector body comprises a second buckling groove disposed on a side of the plugging opening; the buckling member is disposed in the second buckling groove; the buckling member abuts against a sidewall of the second buckling groove away from the first opening.

12. The board end connector according to claim 9 further comprises a circuit board disposed on the housing; the circuit board is disposed on one side of a surface of the connector body having the accommodating opening; the circuit board comprises a plurality of contacting pads disposed at intervals; the plurality of connecting end part of the plurality of terminals of each of the terminal assemblies are electrically connected to the plurality of contacting pads.

13. The board end connector according to claim 12, wherein the connector body comprises a positioning cylinder disposed on a surface of the connector body having the accommodating opening; the circuit board comprises a positioning hole; the positioning cylinder is disposed in the positioning hole.

14. The board end connector according to claim 12, wherein the housing comprises a plurality of plugging members disposed on the periphery of the second opening; the circuit board comprises a plurality of jacks; the plurality of plugging members are respectively inserted into the corresponding jacks.

* * * * *